US007581371B2

(12) United States Patent
Owensby et al.

(10) Patent No.: US 7,581,371 B2
(45) Date of Patent: Sep. 1, 2009

(54) RETAIL PACKAGE FOR FLOWABLE PRODUCTS

(75) Inventors: Joseph Owensby, Spartanburg, SC (US); Randall Cantrell, Simpsonville, SC (US)

(73) Assignee: Cryovac, Inc., Duncan, SC (US)

( * ) Notice: Subject to any disclaimer, the term of this patent is extended or adjusted under 35 U.S.C. 154(b) by 471 days.

(21) Appl. No.: 11/410,711

(22) Filed: Apr. 25, 2006

(65) Prior Publication Data

US 2007/0246391 A1 Oct. 25, 2007

(51) Int. Cl.
*B65B 9/00* (2006.01)

(52) U.S. Cl. ..... 53/459; 53/469; 53/477; 206/466; 206/806

(58) Field of Classification Search ..... 53/455, 53/459, 469, 479, 490; 206/461, 466, 484, 206/525, 806, 820; 222/92, 105, 107, 541.6; 383/13, 21, 22, 200, 205, 906; 426/110, 426/122

See application file for complete search history.

(56) References Cited

U.S. PATENT DOCUMENTS 2,622,986 A * 12/1952 Snyder et al. ..... 383/906
3,184,121 A * 5/1965 Volckening ..... 222/541.6
3,278,085 A * 10/1966 Edward ..... 222/107
4,108,309 A * 8/1978 Bronner ..... 206/528
4,411,358 A 10/1983 Bennwik et al.
4,573,203 A 2/1986 Peppiatt
4,629,080 A 12/1986 Carveth
4,637,063 A 1/1987 Sullivan et al.
4,700,838 A 10/1987 Falciani et al.
4,797,309 A * 1/1989 Kammerer et al. ..... 206/484
4,830,205 A 5/1989 Hammond et al.
4,923,309 A 5/1990 VanErden
4,971,454 A 11/1990 Branson et al.
5,033,868 A 7/1991 Peppiatt (Continued)

FOREIGN PATENT DOCUMENTS

GB 599 183 3/1948

(Continued)

OTHER PUBLICATIONS

Abstract of JP 2000 309372 A (Okura), Nov. 7, 2000 (4 pages).

(Continued)

*Primary Examiner*—Luan K Bui
(74) *Attorney, Agent, or Firm*—Mark B. Quatt

(57) ABSTRACT

A package includes a pouch including a base portion having a first width, the base portion having a closed bottom; and a neck integrally connected to the base portion, the neck having a second width narrower than the first width, the neck including an end portion; and a first easy-open device adapted to remove the end portion from the neck; wherein a common wall formed by the base portion and neck has an outer and inner surface; a discrete cap in connected relationship with the outer surface of the common wall of the pouch, the cap covering the end portion of the neck, the cap including a second easy-open device adapted to remove at least part of the cap and provide access to the end portion of the neck; and a flowable product disposed in the base portion of the pouch. Methods for making a package are also disclosed.

14 Claims, 10 Drawing Sheets

U.S. PATENT DOCUMENTS

| | | | | |
|---|---|---|---|---|
| 5,091,241 | A | 2/1992 | Lang et al. | |
| 5,228,782 | A * | 7/1993 | Imer | 383/906 |
| 5,529,224 | A | 6/1996 | Chan et al. | |
| 5,630,308 | A | 5/1997 | Guckenberger | |
| 5,632,416 | A | 5/1997 | Lane, Jr. et al. | |
| 5,695,338 | A | 12/1997 | Robert | |
| 5,850,939 | A | 12/1998 | Spector | |
| 6,041,928 | A | 3/2000 | Jousinen et al. | |
| 6,050,451 | A | 4/2000 | Hess, III et al. | |
| 6,082,585 | A | 7/2000 | Mader et al. | |
| 6,128,915 | A | 10/2000 | Wagner | |
| 6,241,132 | B1 | 6/2001 | Morrison | |
| 6,312,742 | B1 | 11/2001 | Wood et al. | |
| 6,360,513 | B1 | 3/2002 | Strand et al. | |
| 6,386,760 | B1 | 5/2002 | Tomic | |
| 6,419,121 | B1 | 7/2002 | Gutierrez et al. | |
| 6,536,190 | B1 | 3/2003 | Webb et al. | |
| 6,547,770 | B2 | 4/2003 | Carlsson et al. | |
| 2001/0015054 | A1 * | 8/2001 | Caudle | 53/459 |
| 2003/0091702 | A1 | 5/2003 | Folkmar | |
| 2004/0020940 | A1 * | 2/2004 | Whitney | 222/92 |
| 2004/0180631 | A1 | 9/2004 | Lim et al. | |

FOREIGN PATENT DOCUMENTS

| | | |
|---|---|---|
| JP | 11152153 | 6/1999 |
| JP | 2001231383 | 8/2001 |
| JP | 2002337888 | 11/2002 |
| JP | 2005041556 | 2/2005 |
| SE | 198804186 | 5/1990 |
| WO | 03/031281 | 4/2003 |

OTHER PUBLICATIONS

Abstract of JP 2002 284194 A (Kaneka), Oct. 3, 2002 (2 pages).
Research Disclosure Jun. 2003 "All plastic milk powder with a peelabe outer bag" (3 pages).
PCT/US2007/008356 International Search Report and Written Opinion, 10 pages (Apr. 4, 2007).

* cited by examiner

RETAIL PACKAGE FOR FLOWABLE PRODUCTS

FIELD OF THE INVENTION

This invention relates to a package suitable for storing and dispensing flowable products.

BACKGROUND OF THE INVENTION

It is desirable to package and display a unit portion of a flowable product in a sanitary manner, while providing aesthetic graphics to attract customers. One challenge is the need to keep the dispensing portion of any unitized container sanitary until the consumer is ready to open the container and consume the contents.

Another challenge is to be able to dispense highly viscous fluids, and blends of fluid and solid components, ,in a unit portion package.

SUMMARY OF THE INVENTION

In a first aspect, a package comprises a pouch comprising a base portion having a first width, the base portion having a closed bottom; and a neck integrally connected to the base portion, the neck having a second width narrower than the first width, wherein the neck comprises an end portion; and a first easy-open device adapted to remove the end portion from the neck; wherein a common wall formed by the base portion and neck has an outer surface and an inner surface; a discrete cap in connected relationship with the outer surface of the common wall of the pouch, the cap covering the end portion of the neck, wherein the cap comprises a second easy-open device adapted to remove at least part of the cap and provide access to the end portion of the neck; and a flowable product disposed in the base portion of the pouch.

In a second aspect, a method for making a package comprises providing a package pre-form comprising a pouch comprising a base portion having a first width, the base portion having an open bottom; a neck integrally connected to the base portion, the neck having a second width narrower than the first width, wherein the neck comprises an end portion; and a first easy-open device adapted to remove the end portion from the neck; wherein a common wall formed by the base portion and neck has an outer surface and an inner surface; and a discrete cap in connected relationship with the outer surface of the common wall of the pouch, the cap covering the end portion of the neck, wherein the cap comprises a second easy-open device adapted to remove at least part of the cap and provide access to the end portion of the neck; filling the base portion of the pouch with a flowable product; and closing the open bottom of the pouch of the package pre-form to make a package.

In a third aspect, a method for making a package comprises providing a center-folded film; sealing and trimming the centerfolded film to provide a package pre-form comprising a pouch comprising a base portion having a first width, the base portion having an open bottom; a neck integrally connected to the base portion, the neck having a second width narrower than the first width, wherein the neck comprises an end portion; and a first easy-open device adapted to remove the end portion from the neck; wherein a common wall formed by the base portion and neck has an outer surface and an inner surface; and a discrete cap in connected relationship with the outer surface of the common wall of the pouch, the cap covering the end portion of the neck, wherein the cap comprises a second easy-open device adapted to remove at least part of the cap and provide access to the end portion of the neck; filling the base portion of the pouch with a flowable product; and closing the open bottom of the pouch of the package pre-form to make a package.

BRIEF DESCRIPTION OF THE DRAWINGS

The present invention is illustrated by reference to the following drawings, encompassing different views of various embodiments of the invention, wherein.

DEFINITIONS

Figure 2:
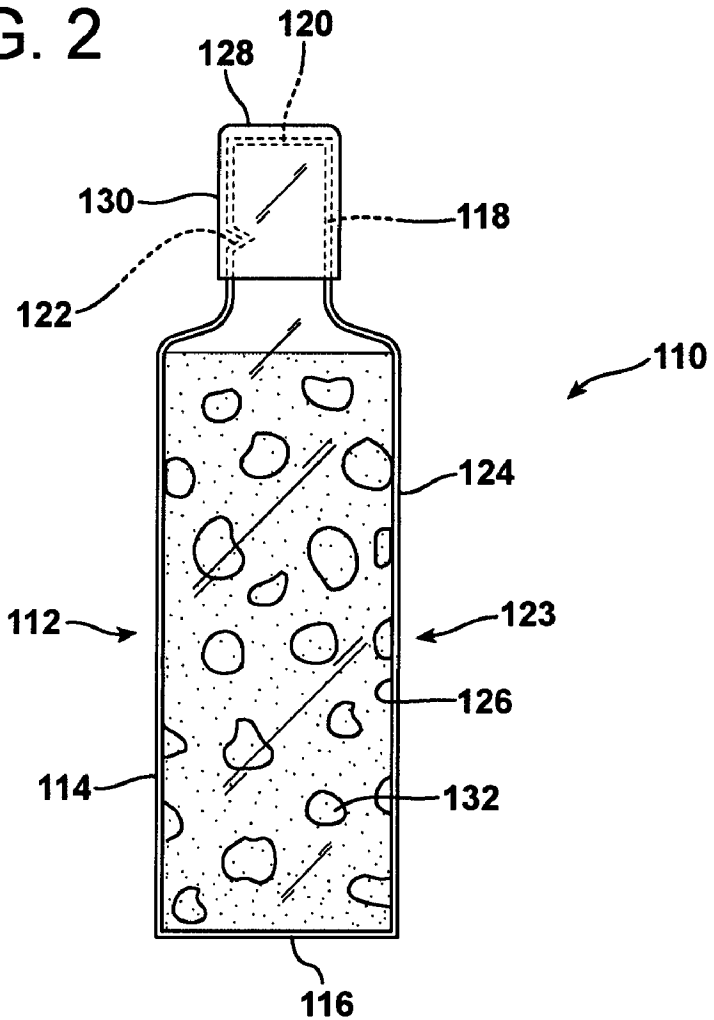
FIG. 2 is a schematic elevational view of a package in accordance with an alternative embodiment of the invention in its sealed and filled condition.

The present invention can be used for storing and dispensing flowable products.

Flowable product" is used herein to mean products including low viscosity fluids, e.g. water, juice, and non-carbonated beverages, where the viscosity can range from about 0.001 Pascal-seconds (ASTM D-2393) to 0.5 Pascal-seconds; high viscosity fluids, e.g. condiments, oils, syrups, sauces, etc. where the viscosity can range from 0.51 Pascal-seconds (ASTM D-2393) to 25 Pascal-seconds: and fluid/solid mixtures, e.g. diced fruit (peaches, pears, apples, etc.) in a syrup, soups, apple sauce, puddings, flavored gelatins, and even small or comminuted solids such as nuts or shelled nuts, sunflower seeds, trail mix, etc, and other consumable foods such as beans and franks, soup with noodles, etc. Non-food products can also be beneficially packaged in pouches of the present invention provided that they are capable of passing through the neck of the inventive package. The present invention finds particular utility in packaging unit portions of flowable food products, and displaying such packages at retail locations.

"Unit portion" is used herein to mean a pre-determined quantity of a flowable product, e.g. a flowable food product intended for consumption by an individual.

"Film" is used herein to mean films, laminates, and webs, either multilayer or monolayer, that may be used in connection with the present invention, for the manufacture of the pouch, cap, or both. The FS laminates, such as FS 7055, sold by Sealed Air Corporation through its Cryovac Division, are examples of packaging materials suitable for the invention. These laminates are described in e.g. U.S. Pat. No. 4,746,562 (Fant), incorporated herein by reference in its entirety. An alternative laminate is based on SCLAIR™ sealant film, an ethylene/alpha-olefin copolymer described in e.g. U.S. Pat. No. 4,521,437 (Storms), incorporated herein by reference in its entirety. A commercial monolayer film from DuPont Canada is FS-3. A commercial multilayer laminate is CL 303. Many other films and laminates useful for dry or wet fluid packaging are available, and can be beneficially used in the present invention. One type of film useful in making the pouch or cap of the invention is a monolayer or multilayer film having at least one layer comprising a barrier material having an oxygen permeability, of the barrier material, less than 500 $cm^3$ $O_2/m^2$·day·atmosphere (tested at 1 mil thick and at 25° C. according to ASTM D3985), such as less than 100, less than 50 and less than 25 $cm^3$ $O_2/m^2$·day·atmosphere such as less than 10, less than 5, and less than 1 $cm^3$ $O_2/m^2$·day·atmosphere. Examples of polymeric materials with low oxygen transmission rates are ethylene/vinyl alcohol copolymer (EVOH), polyvinylidene dichloride (PVDC), vinylidene chloride/methyl acrylate copolymer, polyamide, and polyester. Films can include a polyolefin such as an olefin homopolymer or copolymer, such as ethylene polymer or copolymer, propylene polymer or copolymer, ethylene/alpha olefin copolymer, ethylene/vinyl acetate copolymer, ionomer resin, ethylene/acrylic or methacrylic acid copolymer, ethylene/acrylate or methacrylate copolymer, low density polyethylene, or blends of any of these materials.

"Pouch" herein includes a pouch, a bag, or like containers, either pre-made or made at the point of packaging.

"Filled" with respect to the package herein refers to a package that has been filled with a flowable product in a manner consistent with a commercial filling operation. Thus, the package of the invention may or may not be filled to 100% of its capacity, and can be filled to e.g. 50%, 60%, 70%, 80%, 90% of its capacity, or higher or lower.

"Centerfolded film" herein refers to a film that has been folded on itself along its longitudinal central axis; and alternatively includes two separate films that are brought together in a congruent arrangement such that a pouch of the invention can be made therefrom.

DETAILED DESCRIPTION OF THE INVENTION

EXAMPLES

Figure 1:
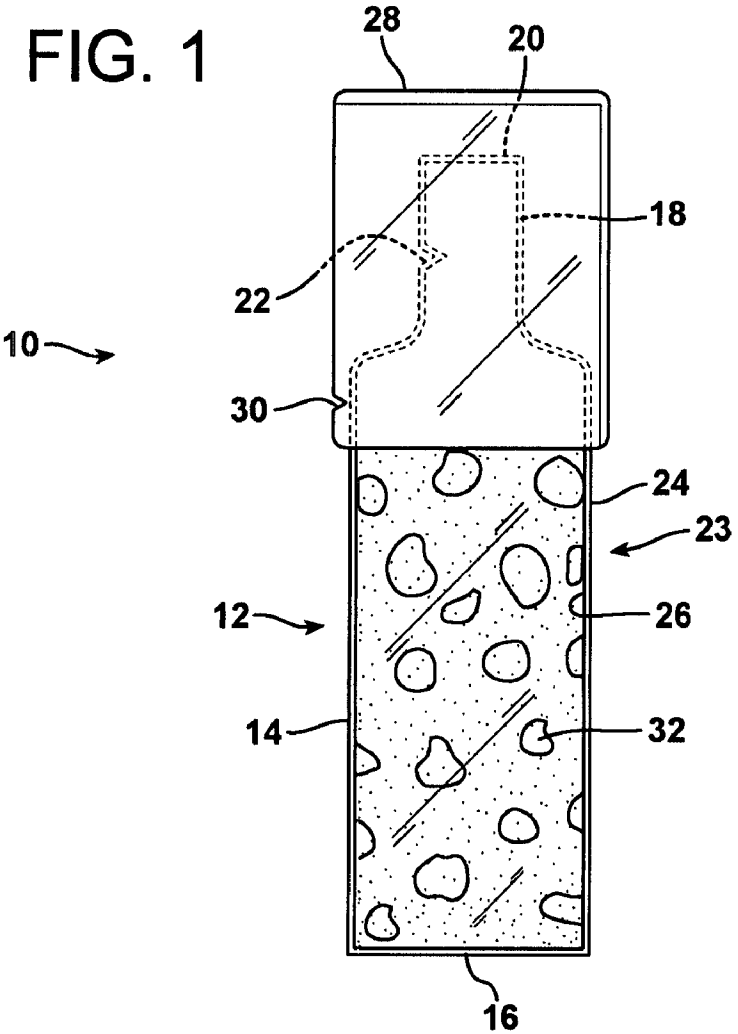
FIG. 1 is a schematic elevational view of a package in accordance with an embodiment of the invention in its sealed and filled condition.
Figure 3:
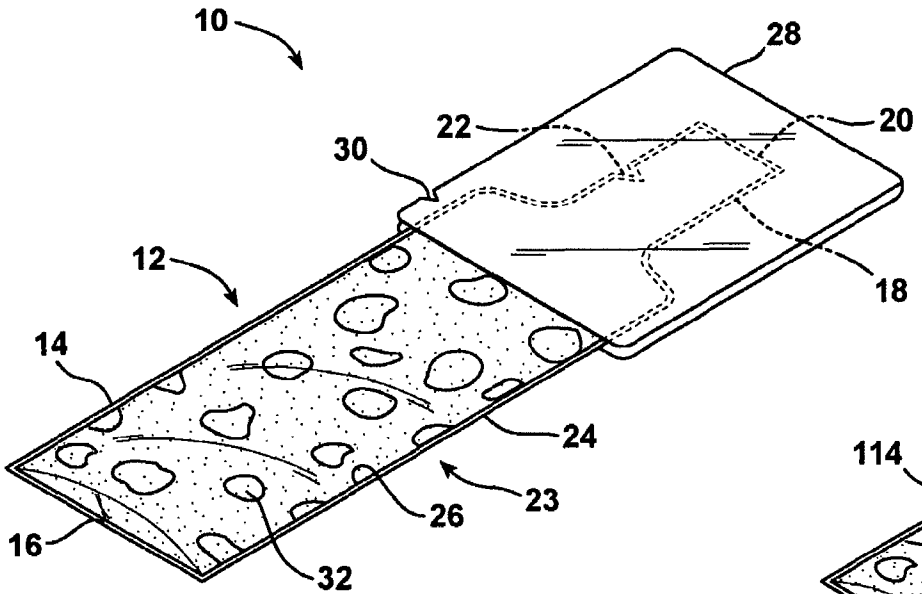
FIG. 3 is a perspective view of the package of FIG. 1.

Referring to FIGS. 1 and 3, a package 10 in accordance with one embodiment of the invention, in its sealed and filled condition, includes a pouch 12 including a base portion 14 having a first width, the base portion 14 having a closed bottom 16; and a neck 18 integrally connected to the base portion 14, the neck 18 having a second width narrower than the first width. The neck 18 includes an end portion 20; and a first easy-open device 22 adapted to remove the end portion 20 from the neck 18.

A common wall 23 formed by the base portion 14 and neck 18 has an outer surface 24 and an inner surface 26. A discrete cap 28 is in connected relationship with the outer surface 24 of the common wall 23 of the pouch 12. Although for the sake of clarity the cap 28 is shown as spaced slightly from the shoulders of the pouch, i.e. the portion of the pouch 12 where the base portion begins to transition towards the neck portion, those skilled in the art will appreciate that cap 28 will be in contact at at least some points with the outer surface 24 of the base portion of the pouch. The cap 28 covers the end portion 20 of the neck 18. Cap 28 includes a second easy-open device 30 adapted to remove at least part of the cap 28 and provide access to the end portion 20 of the neck 18. Package 10 also includes a flowable product 32 disposed in the base portion 14 of the pouch 12.

Figure 4:
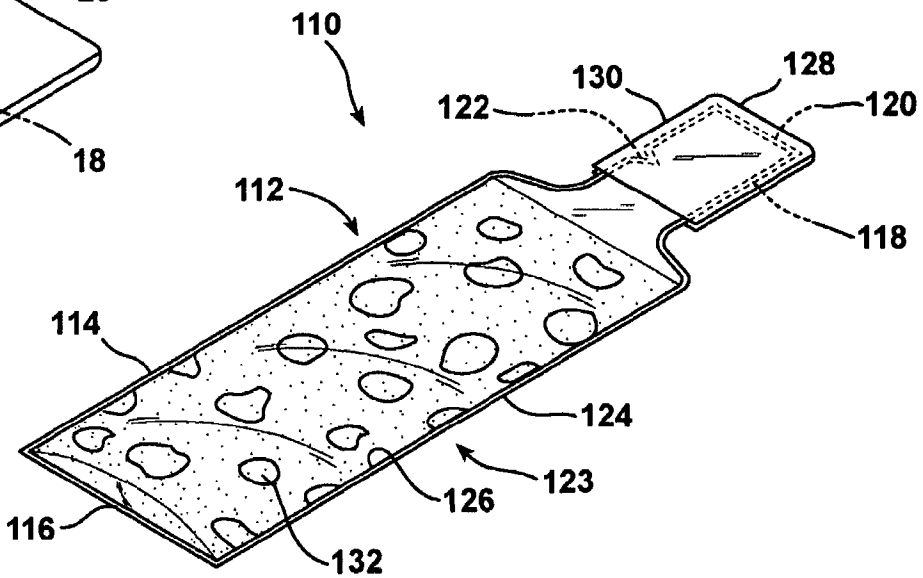
FIG. 4 is a perspective view of a package similar to the package of FIG. 2.

Referring to FIGS. 2 and 4, a package 110 in accordance with an alternative embodiment of the invention, in its sealed and filled condition, includes a pouch 112 including a base portion 114 having a first width, the base portion 114 having a closed bottom 116; and a neck 118 integrally connected to the base portion 114, the neck 118 having a second width narrower than the first width. The neck 118 includes an end portion 120; and a first easy-open device 122 adapted to remove the end portion 120 from the neck 118.

A common wall 123 formed by the base portion 114 and neck 118 has an outer surface 124 and an inner surface 126. A discrete cap 128 is in connected relationship with the neck 118. The cap 128 covers the end portion 120 of the neck 118. Cap 128 includes a second easy-open device 130 adapted to remove at least part of the cap 128 and provide access to the end portion 120 of the neck 118. Package 110 also includes a flowable product 132 disposed in the base portion 114 of the pouch 112.

With respect to FIGS. 1 to 4, and like features in the remaining figures:

The base portion 14 and neck 18, base portion 114 and neck 118, etc. are in one embodiment formed from a continuous single web or container, and thus share common side walls.

The end portion 20 of the neck 18, end portion 120 of the neck 118, etc. is in one embodiment an annular opening that can dispense the contents of the package. The end portion can be of any suitable geometry and diameter, provided it permits the dispensing of flowable products from the neck of the package.

The first easy-open devices 22, 122, etc. can be any device which is adapted to permit the easy opening of the pouch 12, 112, etc. respectively, i.e. the easy removal of the end portion of the neck, without the need for a separate opening device such as a knife. Examples include a tear notch installed along one or more sides of the neck 18; a laser score disposed across the neck; a tear strip; or a weakened area in the film. In the case of a tear notch, it is desirable to provide a thermoplastic film for the pouch that exhibits good tear propagation across the neck of the pouch. If laser scoring is used, the scoring could be patterned to give any predetermined shape lip on the pouch. The lip could thus be removed in an arcuate manner, as opposed to a linear manner in the case of a tear notch with a film having good tear propagation.

The cap 28, 128, etc. is a discrete member which in one embodiment is made separately from the pouch. The cap can take the form of a cover that is adhered by adhesive, heat sealing, pressure fit, a pressure sensitive adhesive, a relatively weak heat seal (i.e. a tear seal), or the like to the base portion of the pouch.

The cap can be of any suitable geometry and diameter, provided it covers the end portion such that the end portion is kept clean until such time as the user desires to access the contents of the package.

The second easy-open device 22 or 122 can be any device which is adapted to permit the easy opening of the package, i.e. the easy removal of at least a portion of the cap, without the need for a separate opening device such as a knife. Examples include a tear notch installed along one or more sides of the cap 28; a laser score disposed across the cap; a tear strip; a pressure sensitive adhesive; or an easily peelable seal that seals the cap to the pouch.

The pouch, including the base portion and neck, and cap can each be made from any suitable material, such as thermoplastic material or metalized thermoplastic material, e.g. a polymer, with a thickness of preferably between 0.1 and 100 mils. Materials include olefinic or amidic polymers or copolymers.

FIG. 2 is similar in most respects to FIG. 1, except that the cap 128 of FIG. 2 is in the form of a label that is adhered to one side of neck 118, passes over and covers end portion 120, and is releasably adhered to the other side of neck 118 via 130.

Methodology

Figure 5C:
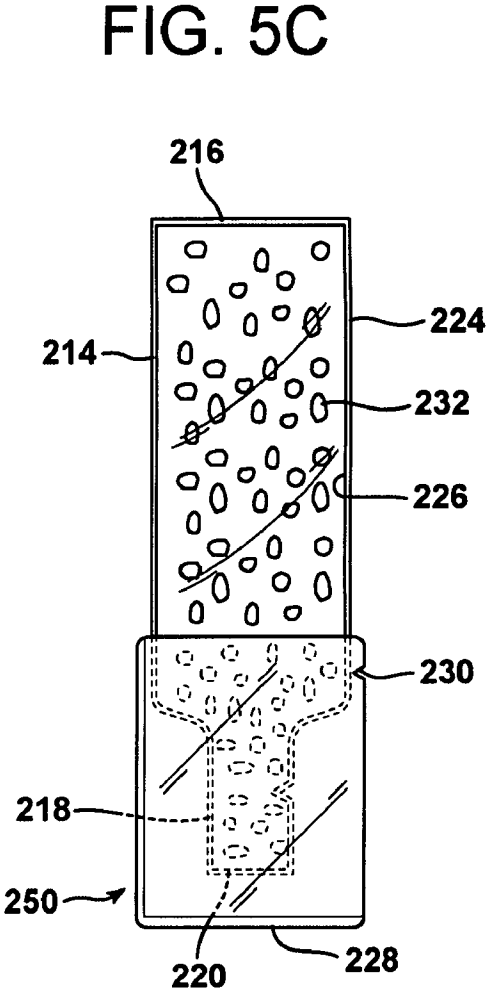
FIGS. 5*a* to 5*c* shows steps in filling package pre-forms in accordance with the invention.
Figure 5B:
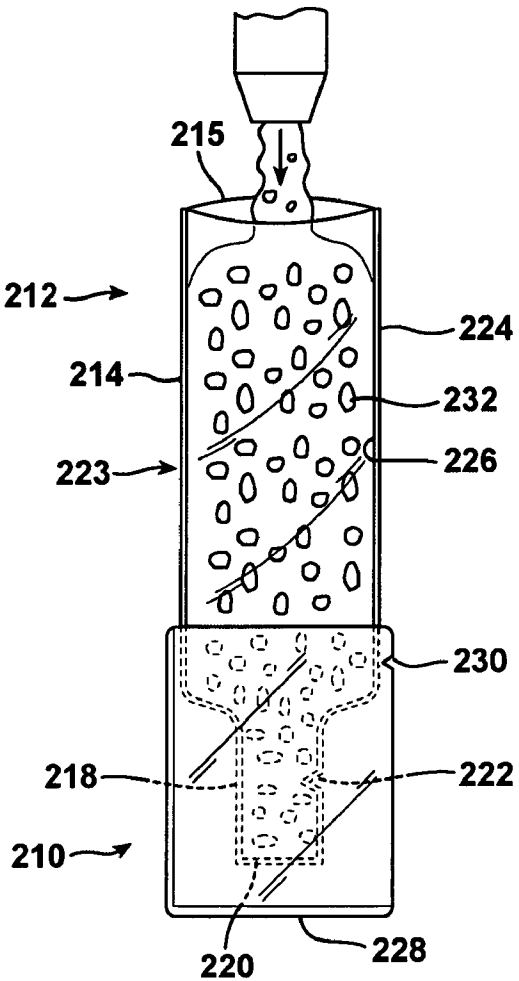
Figure 5A:
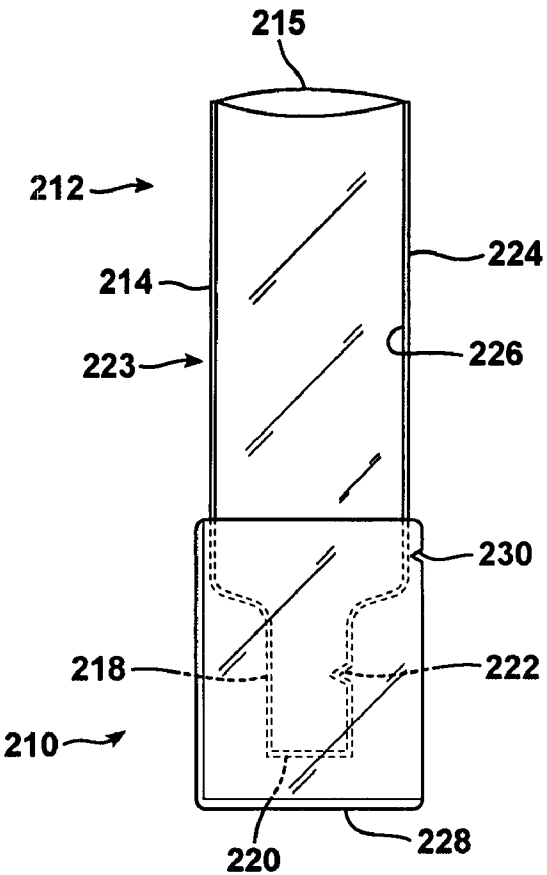

One way of making a package in accordance with the invention is graphically illustrated in FIGS. 5A, 5B, and 5C.

The method includes the step of providing a package pre-form 210 comprising a pouch 212 including a base portion 214 having a first width, the base portion 214 having an open bottom 215; and a neck 218 integrally connected to the base portion 214, the neck 218 having a second width narrower than the first width. Neck 218 comprises an end portion 220; and a first easy-open device 222 adapted to remove the end portion 220 from the neck 218. Common wall 223 formed by the base portion 214 and neck 218 has an outer surface 224 and an inner surface 226. A discrete cap 228 is in connected relationship with the outer surface 224 of the common wall 223 of the pouch 212, the cap 228 covering the end portion 220 of the neck 218. Cap 218 comprises a second easy-open device 230 adapted to remove at least part of the cap 228 and provide access to the end portion 220 of the neck 218.

Package pre-form 210 can be pre-made at an off-site location, and then provided to the food processor or other customer that is practicing this methodology. Alternatively, the package pre-form 210 can be assembled manually or by suitable machinery.

A second step is the filling of the base portion 214 of the pouch 212 with a flowable product 232.

A third step is closing the open bottom 215 of the pouch 212 of the package pre-form 210 to make a package 250. The open bottom 215 is closed by any suitable method, e.g. by heat sealing, to create a closed bottom 216.

The steps of this process can be carried out by otherwise conventional equipment familiar to those of skill in the art.

Those skilled in the art will appreciate that although neck 18, 118, etc. as shown and described throughout this description is illustrated as substantially centrally disposed between the lateral edges of the overall package, i.e. the first and second longitudinal edges of the package and of the pouch, the neck can in some embodiments be disposed such that it is closer to one lateral edge of the pouch and package than the other lateral edge of the pouch and package. Likewise, the exact geometry of the pouch and neck can be varied provided the features of the invention as disclosed and claimed herein are present. Thus for example the pouch can have an end portion that is not at a right angle to the remaining portion of the neck. Also, although the pouch is shown as rectangular in plan view, various shapes can be adopted as desired. These embodiments are also contemplated within the scope of the present invention.

EXAMPLES OF ALTERNATIVE EMBODIMENTS

Figure 6:
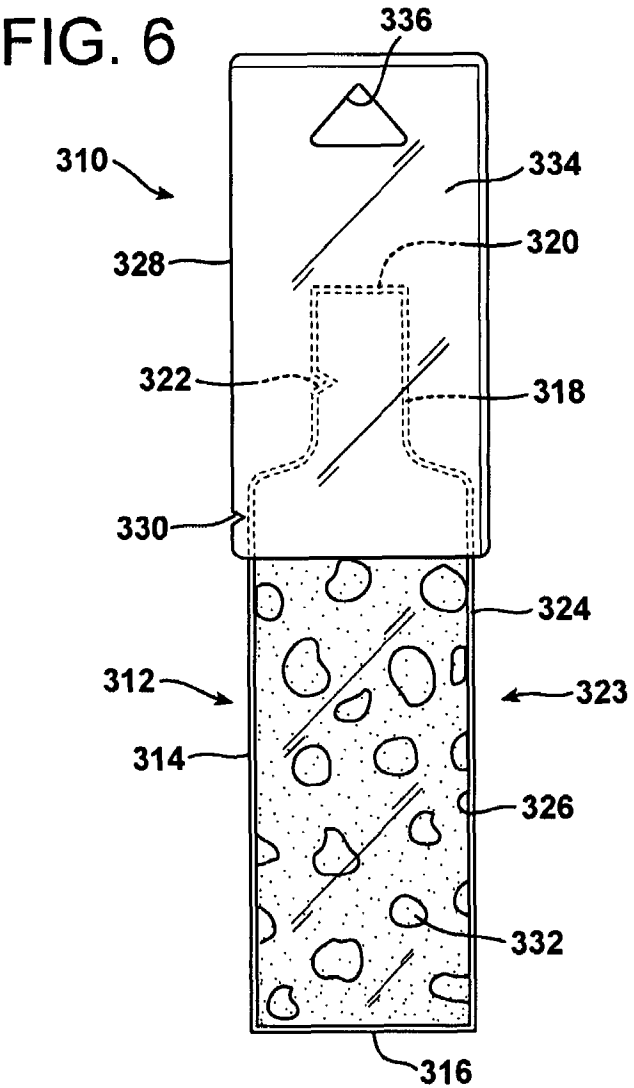
FIG. 6 is a schematic elevational view of a package in accordance with an alternative embodiment of the invention in its sealed and filled condition.

Referring to FIG. 6, a package 310 in accordance with one embodiment of the invention, in its sealed and filled condition, includes a pouch 312 including a base portion 314 having a first width, the base portion 314 having a closed bottom 316; and a neck 318 integrally connected to the base portion 314, the neck 318 having a second width narrower than the first width. The neck 318 includes an end portion 320; and a first easy-open device 322 adapted to remove the end portion 320 from the neck 318.

A common wall 323 formed by the base portion 314 and neck 318 has an outer surface 324 and an inner surface 326. A discrete cap 328 is in connected relationship with the outer surface 324 of the common wall 323 of the pouch 312. Although for the sake of clarity the cap 328 is shown as spaced slightly from the shoulders of the pouch, i.e. the portion of the pouch 312 where the base portion begins to transition towards the neck portion, those skilled in the art will appreciate that cap 328 will be in contact at at least some points with the outer surface 324 of the base portion of the pouch. The cap 328 covers the end portion 320 of the neck 318. Cap 328 includes a second easy-open device 330 adapted to remove at least part of the cap 328 and provide access to the end portion 320 of the neck 318. Package 310 also includes a flowable product 332 disposed in the base portion 314 of the pouch 312.

The package 310 of FIG. 6 differs from the package 10 of FIG. 1 in that package 310 includes a header tab 334 that allows the package 310 to be suspended from a display rack in a retail store environment. Header tab 334 includes a cut-out 336 of any suitable geometry, such as round or triangular as shown, for suspending the package.

Figure 7:
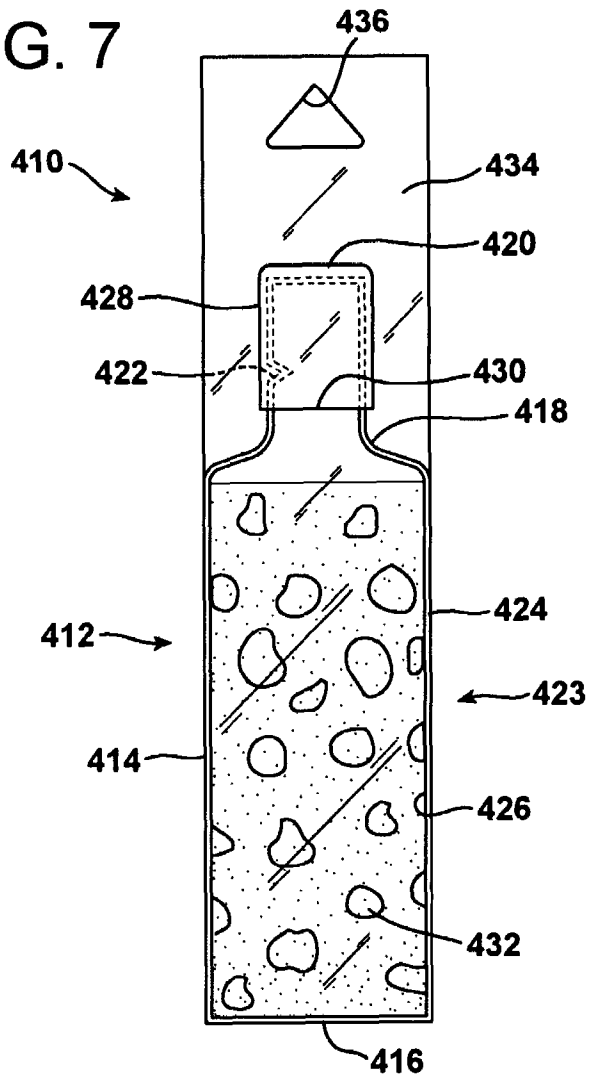
FIG. 7 is a schematic elevational view of a package in accordance with an alternative embodiment of the invention in its sealed and filled condition.

Referring to FIG. 7, a package 410 in accordance with yet another alternative embodiment of the invention, in its sealed and filled condition, includes a pouch 412 including a base portion 414 having a first width, the base portion 414 having a closed bottom 416; and a neck 418 integrally connected to the base portion 414, the neck 418 having a second width narrower than the first width. The neck 418 includes an end portion 420; and a first easy-open device 422 adapted to remove the end portion 420 from the neck 418.

A common wall 423 formed by the base portion 414 and neck 418 has an outer surface 424 and an inner surface 426. A discrete cap 428 is in connected relationship with the neck 418. The cap 428 covers the end portion 420 of the neck 418. Cap 428 includes a second easy-open device 430 adapted to remove at least part of the cap 428 and provide access to the end portion 420 of the neck 418. Package 410 also includes a flowable product 432 disposed in the base portion 414 of the pouch 412.

The package 410 of FIG. 7 differs from the package 110 of FIG. 2 in that package 410 includes a header tab 434 that allows the package 410 to be suspended from a display rack in a retail store environment. Header tab 434 includes a cut-out 436 of any suitable geometry, such as round or triangular as shown, for suspending the package.

With respect to FIGS. 6 and 7, and other embodiments herein that can make use of header tabs, these can be made from any suitable material, such as thermoplastic material, a metal or metalized foil, a metalized thermoplastic, paperboard, or the like, and can form an integral part or extension of a cap (as shown in FIGS. 6 and 7), or an integral part or extension of the pouch, or can be a discrete component that is separately made and then attached to the cap or pouch.

FIG. 7 is similar in most respects to FIG. 6, except that the cap 428 of FIG. 2 is in the form of a label that is adhered to one side of neck 418, passes over and covers end portion 420, and is releasably adhered to the other side of neck 418 via 430.

Figure 8:
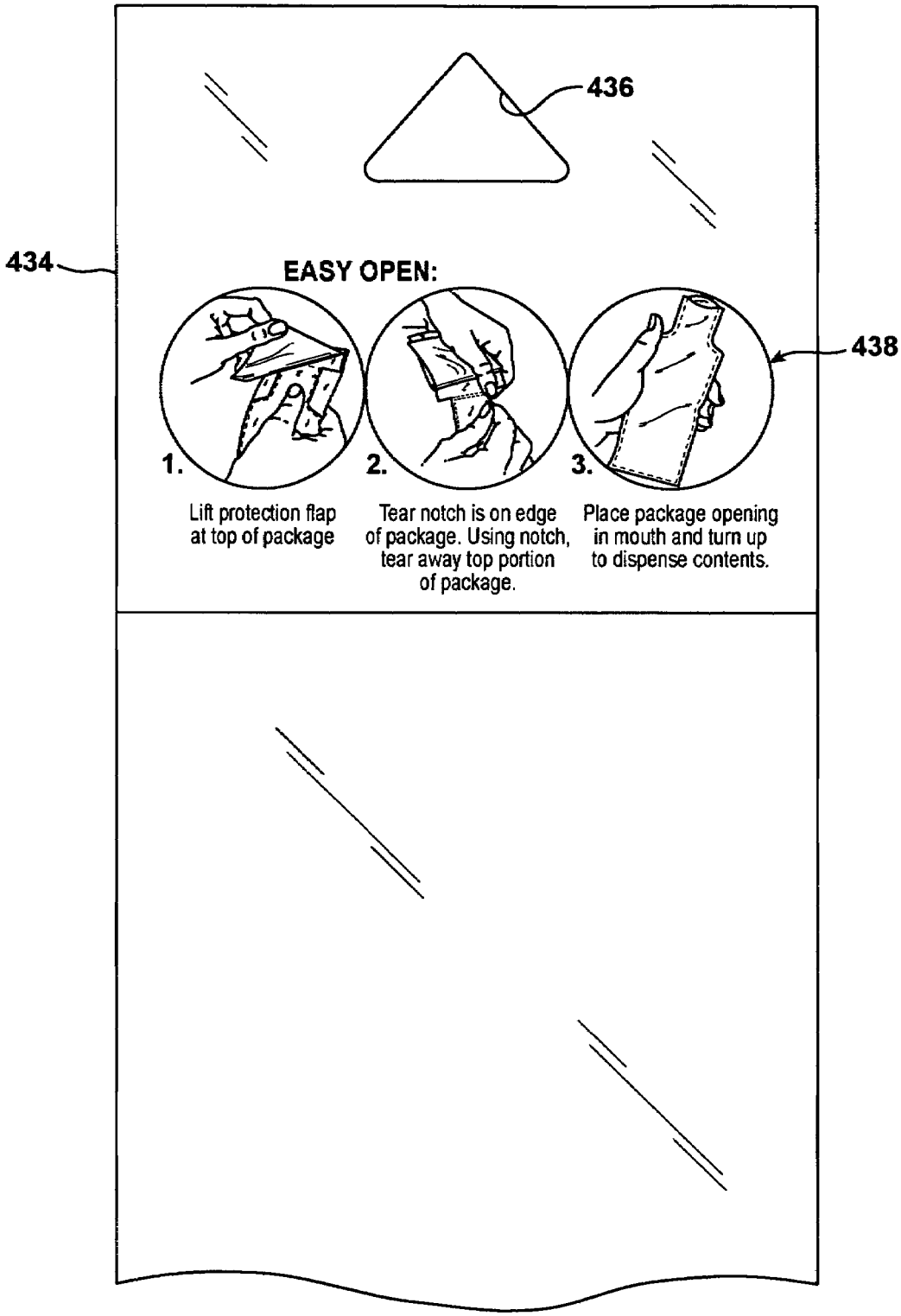
FIG. 8 is a more detailed schematic elevational view of an upper portion of the package of FIG. 7.
Figure 9:
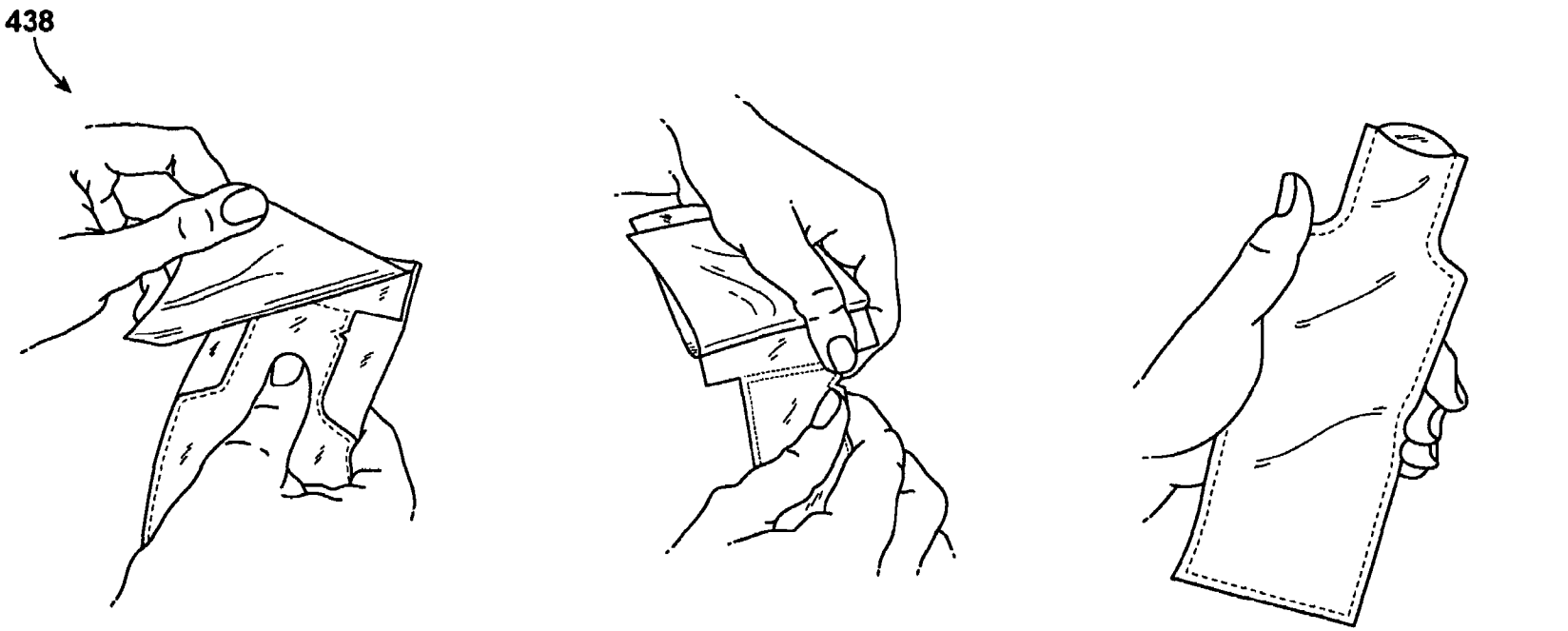
FIG. 9 is an even more detailed schematic elevational view of the graphics of an upper portion of the package of FIG. 7.

FIG. 8 shows an optional detail of header tab 434, including graphic and/or textual indicia for aiding the consumer in opening the package. The indicia is shown in an enlarged view, with modified text, in FIG. 9.

Alternative Methodology

Figure 11:
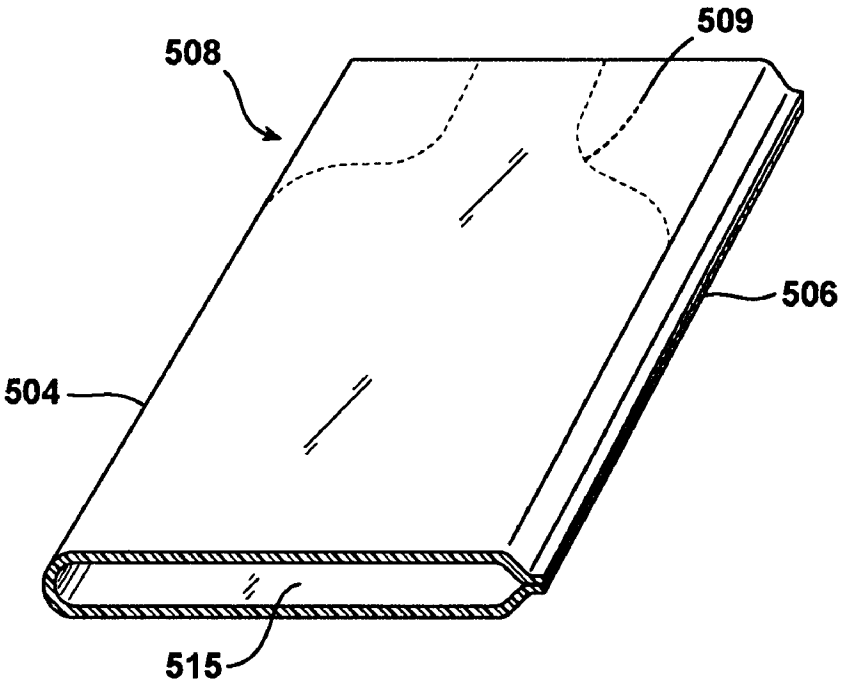
FIG. 11 is a perspective view of the centerfolded film of FIG. 10, wherein the centerfolded film has been sealed along an open side.
Figure 10:
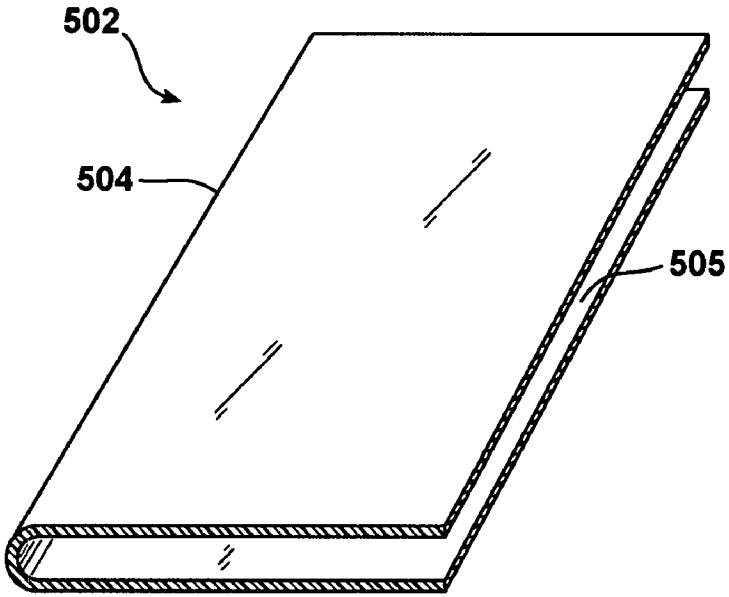
FIG. 10 is a perspective view of a centerfolded film for use in connection with the present invention.
Figure 12:
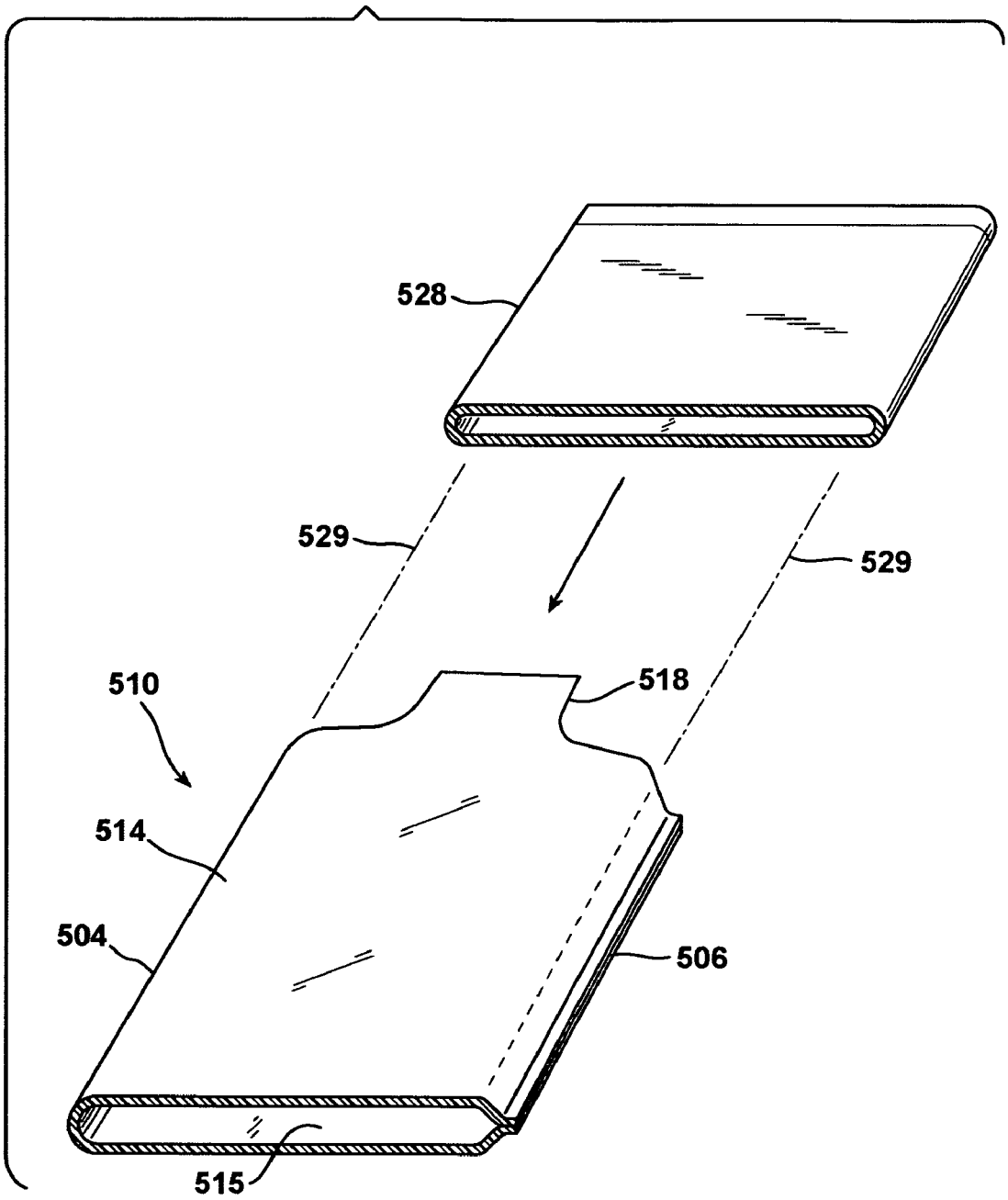
FIG. 12 is a perspective view of a pouch and cap in accordance with the invention.

In another embodiment, referring to FIGS. 10 through 12, a film 502 is folded along fold line 504 such that an open side 505 of the now centerfolded film is made (see FIG. 10). The open side is then sealed, e.g. by heat sealing, to create a tubular preform 508 having side seal 506 (see FIGS. 11 and 12) and an open bottom 515. A pouch pre-form 514 (see FIG. 12) having neck 518 is made by trimming and sealing the tubular pre-form along a predetermined pattern 509. A separate and discrete cap 528 is brought into contact with, and overlaps a portion of pouch pre-form 514 to produce a package pre-form 510. The downward pointing arrow of FIG. 12 indicates relative movement of the cap 528 over a portion of pouch pre-form 514. The cap is then adhered to the pouch pre-form by any of the devices disclosed herein to result in the package pre-form 510 . Suitable easy-open devices (not shown) like those of the preceding examples, are installed on both the neck 518 and cap 528. This package pre-form 510 can then be filled and closed e.g. as disclosed herein in FIGS. 5A to 5C. The steps of this process can be carried out by otherwise conventional equipment familiar to those of skill in the art.

As an alternative to a centerfolded film in which one side of the film is formed by a longitudinal fold, two separate films can be brought together in a congruent arrangement such that a pouch of the invention can be made therefrom. In this embodiment, 504 represents a heat seal that joins the congruent side edges of the respective films together.

Figure 13:
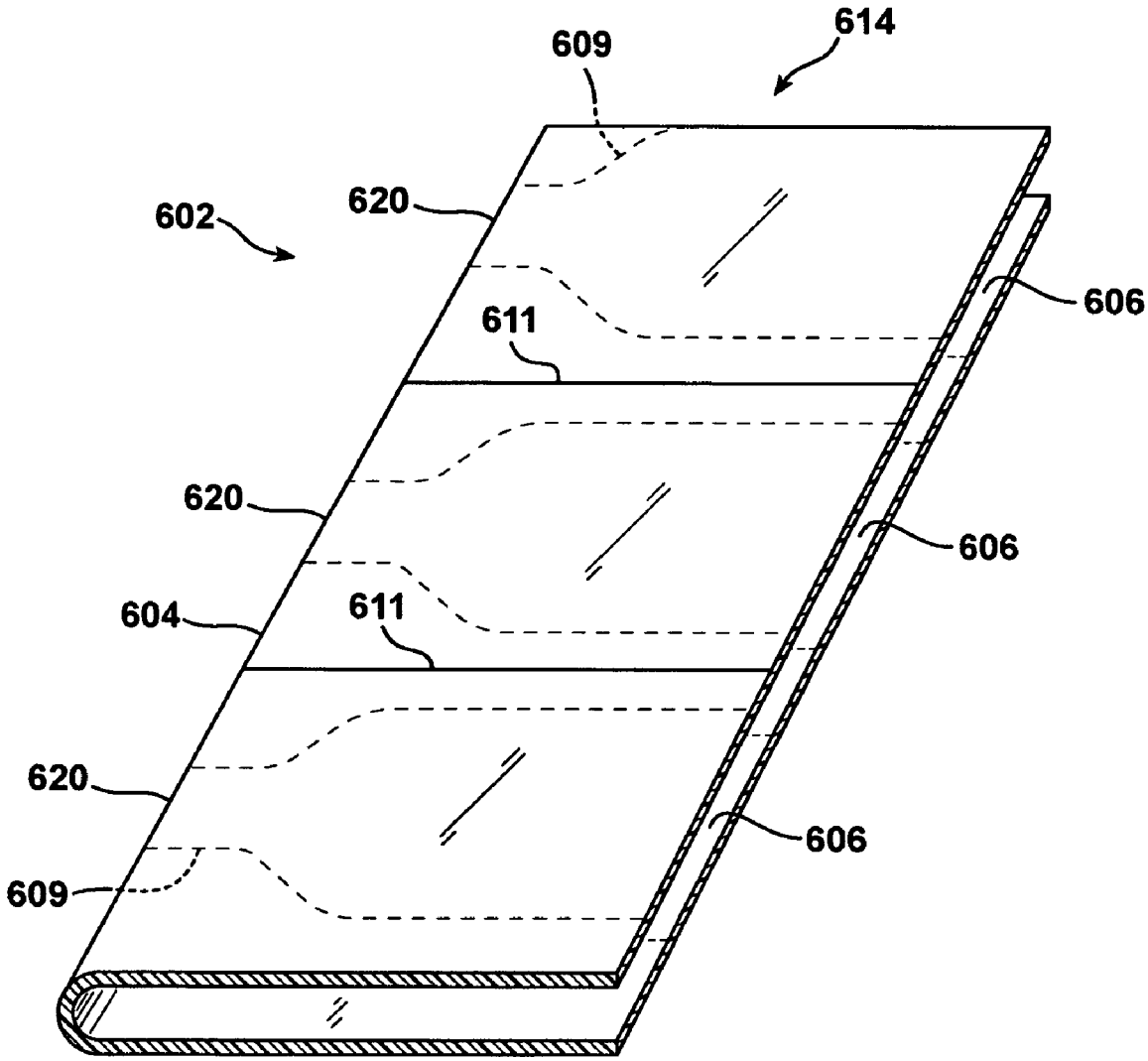
FIG. 13 is a perspective view of a centerfolded film for use in connection with another embodiment of the present invention.
Figure 14:
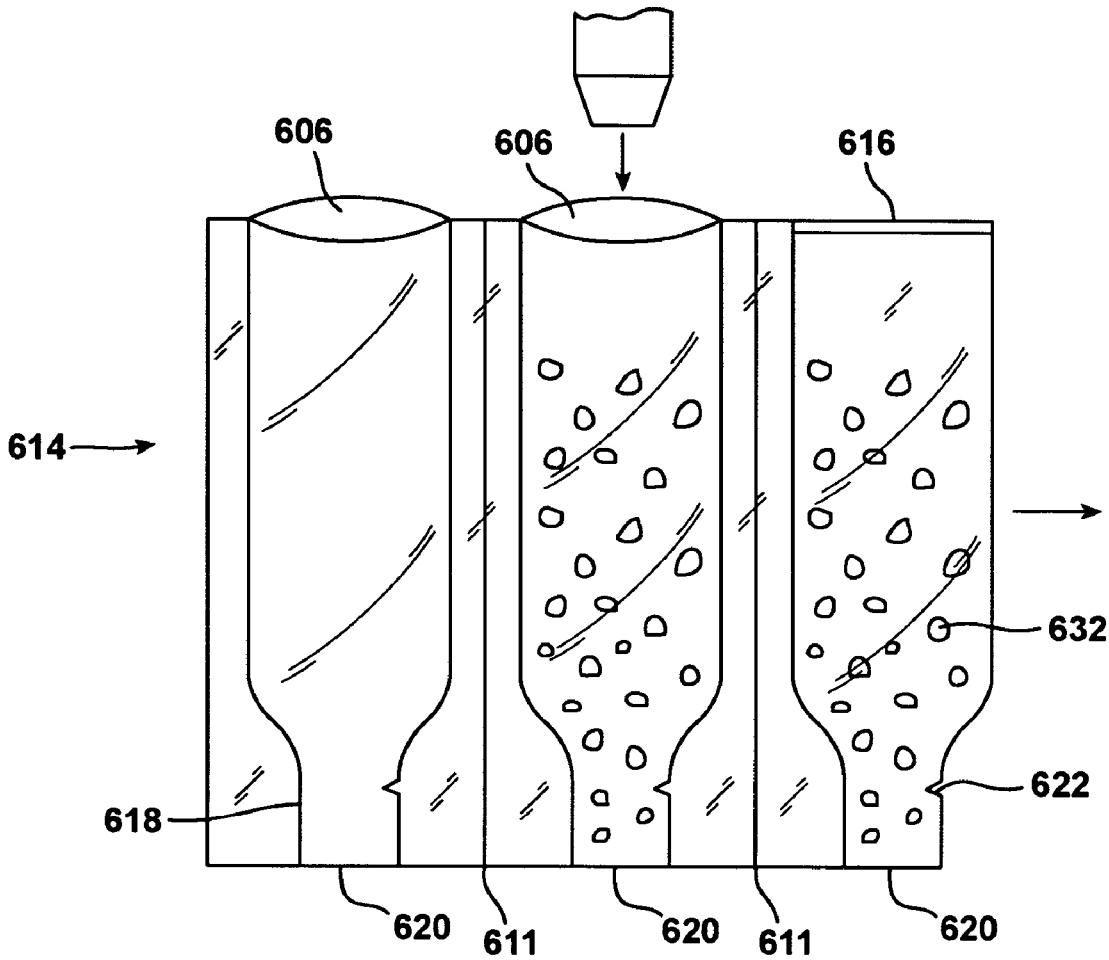
FIG. 14 shows an alternative scheme for filling pouches in accordance with the invention.

In yet another alternative embodiment, FIG. 13 shows a centerfolded film 602 so arranged that the fold line 604 can be utilized as the closed end portion 620 of the neck of a pouch, such that the open side 606 serves as the open bottom of the pouch. In this embodiment, pouch pre-forms 614 are made by sealing the pre-forms along a predetermined pattern 609, for example by heat sealing. Sealing occurs through both plies of the centerfolded film 602 to create pouch pre-forms with sealed sides, each pouch pre-form having a base portion and neck. The array of pouch pre-forms is shown in FIG. 14, where a filling arrangement similar to that shown in FIGS. 5A to 5C can be used, in which the pouch pre-forms can be aligned in a row and fed into a filling machine, either singly or in a connected array or train of pouch pre-forms. Side heat seals or other appropriate seals can be used to close the sides of each respective pouch either before or during the filling process. Caps can be installed on each pouch or pouch pre-form either before the filling operation, as in the embodiment of FIGS. 5A to 5C, or alternatively during or after the filling operation, by any suitable manual or mechanical means.

As shown in FIGS. 13 and 14, some pouch material may in some embodiments be present between adjacent pouch pre-forms 614. This material may be kept intact to facilitate advancing and filling of the pouches in an array as shown in FIG. 14. At some point after filling, this material can than be removed with a knife or other cutting or separating device in order to separate the resultant filled pouches. Drawing reference numeral 611 can represent in one embodiment a centerline defining film material disposed between and connecting two adjacent pre-forms 614. In another embodiment, reference numerals 614 represent the lateral edge of a side heat seal of one pouch pre-form, and a side heat seal of an adjacent pouch pre-form.

The present invention offers the ability to keep a dispensing portion of a unit portion package clean. This facilitates the marketing of a wide variety of goods, particularly food products and more particularly highly viscous food products, and fluid/solid combinations, in single servings at e.g. convenience stores. The package of the invention can also be beneficially used for camping and for school lunches because of the sanitary feature of the package.

By providing a package where the cap is discrete from the pouch, different materials can be used for the cap and pouch respectively. This provides an opportunity to separately select and optimize the material for the cap and pouch. For example, the material for the pouch can be chosen based on properties such as toughness, oxygen transmission rate, food law compliance, etc. The material for the cap can be chosen based on properties such as printability (for graphics). If the cap is in the form of a label, an adhesive label can be used that provides for resealability of the pouch after initial use by the consumer.

First easy-open devices 22, 122, 222, 322, and 422, and second easy-open devices 30, 130, 230, 330, and 430, can be installed or created on or in the neck of the respective pouch, pouch pre-form, or on or in the cap, at any suitable time during the making of the pouch, pouch pre-form, cap, or package. For example, a tear notch can be made by any suitable knife or seal bar/knife combination, in the perimeter area of the neck of the pouch or pouch-preform, or the cap, e.g. in the seal area created during production of the profile 509 or 609, or during production of the pouch or pouch pre-form. The tear notch of the cap can be made during production of the cap before being attached to the pouch or pouch pre-form, or after being so attached. A pressure sensitive adhesive can be of any suitable type, and can be applied manually or by otherwise conventional techniques to the cap, including a cap in the form of a label.

What is claimed is:

1. A method for making a package comprising:

a) providing a package pre-form comprising:

i) a pouch comprising a base portion having a first width, the base portion having an open bottom; a neck integrally connected to the base portion, the neck having a second width narrower than the first width, wherein the neck comprises an end portion and a first easy-open device adapted to remove the end portion from the neck; wherein a common wall formed by the base portion and neck has an outer surface and an inner surface; and ii) a discrete cap in connected relationship with the outer surface of the common wall of the pouch, the cap covering the end portion of the neck, wherein the cap comprises a second easy-open device adapted to remove at least part of the cap and provide access to the end portion of the neck;

b) filling the base portion of the pouch with a flowable product; and c) closing the open bottom of the pouch of the package pre-form to make a package.

2. The method of claim 1 wherein the base portion and neck together comprise a single, continuous pouch.

3. The method of claim 1 wherein the first easy-open device is selected from the group consisting of a tear notch, a laser score disposed across the neck; a tear strip; and a weakened area in the film.

4. The method of claim 1 wherein the second easy-open device is selected from the group consisting of a tear notch, a laser score disposed across the cap; a tear strip; a pressure sensitive adhesive, and an easily peelable seal that seals the cap to the pouch.

5. The method of claim 1 wherein the cap comprises a label that is adhered to a first side of the neck, extends across and covers the end portion of the neck, and is removably adhered to a second side of the neck.

6. The method of claim 1 wherein the flowable food product comprises a viscous liquid, or a blend of a liquid and a solid.

7. The method of claim 1 wherein the open bottom of the pouch is closed by heat sealing.

8. A method for making a package comprising:

a) providing a centerfolded film;

b) sealing and trimming the centerfolded film to provide a package pre-form comprising:

i) a pouch comprising a base portion having a first width, the base portion having an open bottom; a neck integrally connected to the base portion, the neck having a second width narrower than the first width, wherein the neck comprises an end portion and a first easy-open device adapted to remove the end portion from the neck; wherein a common wall formed by the base portion and neck has an outer surface and an inner surface; and ii) a discrete cap in connected relationship with the outer surface of the common wall of the pouch, the cap covering the end portion of the neck, wherein the cap comprises a second easy-open device adapted to remove at least part of the cap and provide access to the end portion of the neck;

c) filling the base portion of the pouch with a flowable product; and d) closing the open bottom of the pouch of the package pre-form to make a package.

9. The method of claim 8 wherein the base portion and neck together comprise a single, continuous pouch.

10. The method of claim 8 wherein the first easy-open device is selected from the group consisting of a tear notch, a laser score disposed across the neck; a tear strip; and a weakened area in the film.

11. The method of claim 8 wherein the second easy-open device is selected from the group consisting of a tear notch, a laser score disposed across the neck; a tear strip; a pressure sensitive adhesive, and an easily peelable seal that seals the cap to the pouch.

12. The method of claim 8 wherein the cap comprises a label that is adhered to a first side of the neck, extends across and covers the end portion of the neck, and is removably adhered to a second side of the neck.

13. The method of claim 8 wherein the flowable food product comprises a viscous liquid, or a blend of a liquid and a solid.

14. The method of claim 8 wherein the open bottom of the pouch is closed by heat sealing.

* * * * *